US005244512A

United States Patent [19]

Kawasaki et al.

[11] Patent Number: 5,244,512

[45] Date of Patent: Sep. 14, 1993

[54] METHOD FOR TREATING METAL SURFACE WITH ZINC PHOSPHATE

[75] Inventors: Isao Kawasaki; Minoru Ishida, both of Osaka; Asao Mochizuki; Haruo Kojima, both of Aichi, all of Japan

[73] Assignee: Nippon Paint Co., Ltd., Osaka, Japan

[21] Appl. No.: 883,438

[22] Filed: May 15, 1992

[30] Foreign Application Priority Data

May 18, 1991 [JP] Japan ..... 3-113572

[51] Int. Cl.[5] ..... C23C 22/12; C23C 22/16

[52] U.S. Cl. ..... 148/260; 148/262

[58] Field of Search ..... 148/262, 260

[56] References Cited

U.S. PATENT DOCUMENTS 4,838,957 6/1989 Miyamoto et al. .
4,849,031 7/1989 Hauffe et al. .

FOREIGN PATENT DOCUMENTS 0019430 11/1980 European Pat. Off. .
060716A1 9/1982 European Pat. Off. .
106459B1 4/1984 European Pat. Off. .
381190A1 8/1990 European Pat. Off. .
434358A2 6/1991 European Pat. Off. .
454361A2 10/1991 European Pat. Off. .
57-70281 4/1982 Japan .
57-152472 9/1982 Japan .
61-104089 5/1986 Japan .
61-36588 8/1986 Japan .
3-191071 8/1991 Japan .
3-240972 10/1991 Japan .
4-6281 1/1992 Japan .
92/07974 5/1992 World Int. Prop. O. .

*Primary Examiner*—Sam Silverberg
*Attorney, Agent, or Firm*—Lowe, Price, LeBlanc & Becker

[57] ABSTRACT

A method for treating a metal surface with zinc phosphate of this invention can treat an iron-based surface, a zinc-based surface, an aluminum-based surface as well as a metal surface having two kinds or more of these surfaces with the same zinc phosphate treating solution, and even if treating times increases, the method makes it possible to form a coating film having superior adhesion and high corrosion resistance under a stable condition, and also, it prevents a precipitate formed by a metal ion eluted from a metal surface to be treated, especially, by an aluminum ion. A complex fluoride compound contained in said zinc phosphate treating solution of coming in contact with a metal surface is added so that a concentration (unit: g/l) converted into at least one of a hexafluorosilicic acid group ($SiF_6^{2-}$) and a tetrafluoroboric acid group ($BF_4^-$), with an aluminum ion concentration (unit: g/l) contained in said treating solution, is satisfactory for the following equation (I).

$$3.0 \geqq [SiF_6^{2-}] + \frac{1}{5}[BF_4^-] - 8[Al^{3+}] \geqq 0.1 \quad (I)$$

3 Claims, No Drawings

METHOD FOR TREATING METAL SURFACE WITH ZINC PHOSPHATE

BACKGROUND OF THE INVENTION

The present invention relates to a method for treating a metal surface, which is offered for coating, with zinc phosphate. In detail, it relates to a treating method to make a zinc phosphate coating film which is suitable for an electrodeposition coating, especially, for a cationic electrodeposition coating, and which is superior in coating film adhesion, corrosion resistance, especially, warm brine resistance, and a property to prevent rust of a scab type (scab corrosion) (hereinafter, referred to as "scab resistance").

Metal materials have been used in various fields such as automobile bodies and other attachments, building materials, furniture etc. Metal is treated with zinc phosphate as coating pretreatment to prevent corrosion resulting from oxygen or sulfur oxides in the air, rainwater, seawater and so forth. A zinc phosphate film thus-formed is required to be superior in adhesion to a metal surface substrate, and also, to be superior in adhesion (secondary adhesion) to a coating film being made on the zinc phosphate film and also, it is required to have sufficient rust-preventability under a corrosive environment. In particular, since an automobile body is repeatedly exposed to contact with salt water as well as variation of dry and wet atmospheric conditions at a scar of the external plate, the scab resistance and a high order of warm brine resistance have been desired.

Recently, there has been increased a case of treating with zinc phosphate for a metallic material having two kinds or more of metal surfaces. For example, to elevate the corrosion resistance of after-coating in a case of the automobile body, a material plated by zinc or by a zinc alloy on only one face of a steel material is used. If a conventional zinc phosphate treatment is carried out on such a metal surface having both of an iron-based surface and a zinc-based surface simultaneously, the zinc-based surface is inferior in corrosion resistance and secondary adhesion when compared with the iron-based surface. Because of this, for example, in Japanese Official Patent Provisional Publication, showa 57-152472 etc., there has been proposed a method for making a zinc phosphate coating film suitable for an electrodeposition coating on the metal surface having both of an iron-based surface and a zinc-based surface simultaneously. In this method, at least one of a manganese ion having a concentration of from 0.6 to 3 g/l and a nickel ion having a concentration of from 0.1 to 4 g/l is contained in a treating bath in which concentrations of a zinc ion, a phosphate ion and a coating film-converting accelerator are controlled. Further, in Japanese Examined Patent Publication, showa 61-36588, there has been proposed an art which comprises adding a fluorine ion of 0.05 g/l or more together with a manganese ion in order to lower a treating temperature.

A material made by combining an aluminum material with an iron or a zinc material has been practically used in various fields such as automobiles, building materials, etc.

If a material of this kind is treated with a conventional acidic zinc phosphate treating solution used for a conventional iron or zinc material, the aluminum ion eluted to the treating solution accumulates and, when the amount of aluminum ions becomes certainly high, there is a problem that inferior chemical conversion occurs in an order of an aluminum material and iron material. Since the aluminum material has better corrosion resistance when compared with an iron or a zinc material, the amount of a zinc phosphate coating film forming on the aluminum material has not so far been prescribed. However, recently, because of an increasing demand for rust prevention, in order to enhance corrosion resistance of the aluminum material, a need to secure a coating film in a certain amount on the material surface has occurred.

Accordingly, to prevent an increase of aluminum ions in a treating solution, there has been proposed in Japanese Official Patent Provisional Publication, showa 57-70281, a method in which the aluminum ions are precipitated as $K_2NaAlF_6$ or $Na_3AlF_6$ by adding acid potassium fluoride and acid sodium fluoride into a treating solution. Also, there has been proposed in Japanese Official Patent Provisional Publication, showa 61-104089, a method in which the concentration of aluminum ions in a fluorine-based zinc phosphate treating solution is maintained at 70 ppm or less by controlling an area ratio of an aluminum-based surface to an iron-based surface at 3/7 or less.

The zinc phosphate treating method described in the Japanese Official Patent Provisional Publication, showa 61-104089, has a disadvantage so that an object to be treated is very limited, and also, it is difficult to maintain the concentration of aluminum ions at 70 ppm or less by only controlling the forementioned area ratio. On the other hand, the method described in the Japanese Official Patent Provisional Publication, showa 57-70281, does not limit an object to be treated, and it is superior in a point of adopting an idea such as aluminum ions in a treating solution is eliminated by precipitating them. However, a precipitate here formed shows a tendency of floating and suspending and attaches to a zinc phosphate coating film and makes the film ununiform. Because of this, in a case where electrodeposition coating is carried out on a zinc phosphate coating film, electrodeposition coating inferiority occurs and this inferiority becomes an origin of uniformity lack on a coating film and secondary adhesion inferiority of a coating film. Therefore, it is necessary to remove the precipitate of a floating and suspending character, but this removal is a complicate operation.

SUMMARY OF THE INVENTION

Accordingly, it is an object of the present invention to provide a method for treating a metal surface with zinc phosphate which comprises applicability of the same zinc phosphate treating solution for an iron-based, a zinc-based and an aluminum-based surface as well as a metal surface having two kinds or more of these surfaces, and even if treating times increases, which can make a coating film having high corrosion resistance and superior adhesion under a stable condition, and which can prevent a precipitate in a treating solution formed by a metal ion eluted from a metal surface to be treated, especially, by an aluminum ion.

To solve the object, the present invention provides a method for treating a metal surface with zinc phosphate, which comprises making a zinc phosphate coating film on the metal surface by bring the metal surface in contact with a zinc phosphate treating solution, being characterized by adding a complex fluoride compound so that a concentration of the complex fluoride compound contained in the treating solution when converted into at least one of a hexafluorosilicic acid group ($SiF_6^{2-}$) and a tetrafluoroboric acid group ($BF_4^-$), with an aluminum ion concentration contained in said treating solution, is satisfactory for the following equation (I), wherein unless otherwise stated, the concentration unit is hereinafter "g/l" and the hexafluorosilicic acid group and the tetrafluoroboric acid group are hereinafter referred to as "$SiF_6$" and "$BF_4$", respectively.

$$3.0 \geqq [SiF_6^{2-}] + \frac{1}{5}[BF_4^-] - 8[Al^{3+}] \geqq 0.1 \quad \text{(I)}$$

The present inventors found the following facts as a result of extensive researches carried out to solve the above objects.

(1) When a complex fluoride compound is contained, in a concentration converted into $SiF_6$, in a concentration of more than eight times of the aluminum ion concentration contained in a treating solution, the same treating solution can be applied for an iron-based, a zinc-based and an aluminum-based surface as well as for a metal surface having two kinds or more of these surfaces simultaneously and, even if concentration of eluted aluminum ions becomes high, formation of an aluminum ion precipitate as well as deterioration by the aluminum ion of conversion treatment do not occur at all or do not almost occur.

(2) If a difference between a concentration converted into $SiF_6$ of a complex fluoride compound and a concentration of eight times of the aluminum ion concentration is less than 0.1 g/l, a uniform zinc phosphate coating film is not made on an aluminum-based surface and there occurs a problem that corrosion resistance of the surface after being coated deteriorates.

(3) If the difference between a concentration converted into $SiF_6$ of a complex fluoride compound and a concentration of eight times of the aluminum ion concentration exceeds 3.0 g/l, because the complex fluoride compound exists too much, the iron-based surface is etched too much and an amount of converted coatings diminishes, so that the corrosion resistance of the surface after being coated deteriorates.

(4) If the complex fluoride compound is contained in a treating solution at a $BF_4$-converted concentration of forty times or more of the aluminum ion concentration being contained in the treating solution, the same treating solution can be applied for an iron-based, a zinc-based and an aluminum-based surface as well as for a metal surface having two kinds or more of these surfaces simultaneously and, even if a concentration of eluted aluminum ions becomes high, formation of an aluminum ion precipitate and deterioration of conversion treating do not occur at all or do not almost occur.

In the present invention, a treating solution is managed in concentration so as to contain a complex fluoride compound in a range represented by the forementioned equation (I). The concentration management of the complex fluoride compound in the treating solution is carried out, for example, as follows. Since the amounts of each aluminum, silicon and boron element in the treating solution are measured by atomic absorption spectrometry or induction bond plasma emission analysis and the amount of fluorine element in the treating solution is measured by a commercially available fluorine meter, the concentration management can be carried out on a basis of these measurements. However, the concentration management is not limited to the above procedure.

Meanwhile, according to the present invention, when an article having an aluminum-based surface is treated, the aluminum ion accumulates in the treating solution. However, in usual, the aluminum ion concentration does not endlessly increase and, because the treating solution is brought out with attaching to the article to be treated and a supplementary solution such as the undermentioned is added, the aluminum ion concentration is usually depressed less than a certain concentration and, the aluminum ion concentration of this kind can be sufficiently treated by a treating method in the present invention.

In a method for treating a metal surface with zinc phosphate of this invention, when the metal surface is treated with zinc phosphate by immersing it in a treating solution, it is preferred to add a complex fluoride compound so that a concentration of the complex fluoride compound contained in the treating solution, when converted into at least one of $SiF_6$ and $BF_4$, with the aluminum ion concentration in the treating solution, is satisfactory for the following equation (II).

$$3.0 \geqq [SiF_6^{2-}] + \frac{1}{5}[BF_4^-] - 8[Al^{3+}] \geqq 0.5 \quad \text{(II)}$$

If the concentration is lower than the range, as the aluminum ion concentration in the treating solution increases, the capability of zinc phosphate treatment deteriorates occasionally.

Although a metal surface to be treated by a zinc phosphate treating method of this invention is a solely iron-based, a solely zinc-based and a solely aluminum-based surface as well as a metal surface having two kinds or more of these surfaces, the zinc phosphate treating method is most effective in a case where a metal surface jointly having an aluminum-based surface is treated. Also, the metal surface may have a plane sheet shape or a bag structure and thus, it has no special limitation. According to this invention, an interior surface of the bag structure can be treated similarly to cases of an exterior surface and a plane sheet.

If the forementioned treating solution contains a simple fluoride compound such as hydrofluoric acid or the like, the aluminum ion may form sludge of a floating and suspending character. However, the treating solution is able to contain a simple fluoride compound in a range of not forming sludge of the above type.

The kind and concentration of components other than the complex fluoride compound contained in the treating solution are set similarly to the case of common zinc phosphate treating solutions. Among these other components, a zinc ion, a phosphate ion and a coating film-converting accelerator (a) needs to be at least contained, but residual components may be properly combined if required.

Among main components of the treating solution used in this invention, components other than the complex fluoride compound are, for example, a zinc ion, a phosphate ion and a coating film-converting accelerator (a). A preferable coating film-converting accelerator (a) for use is at least one kind selected from a nitrite ion, m-nitrobenzenesulfonic acid ion and hydrogen peroxide. A preferable concentration of these compounds is, for example, as follows (a more preferable concentration is shown in parentheses): for a zinc ion, 0.1 to 2.0 g/l (0.3 to 1.5); for a phosphate ion, 5 to 40 g/l (10 to 30); for a nitrite ion, 0.01 to 0.5 g/l (0.01 to 0.4); for a m-nitrobenzenesulfonic acid ion, 0.05 to 5 g/l (0.1 to 4);

and for hydrogen peroxide (when converted into 100% hydrogen peroxide) 0.5 to 10 g/l (1 to 8).

If the zinc ion concentration is less than 0.1 g/l, a uniform zinc phosphate coating film is not formed on a metal surface, much lack of hiding is found, and a coating film of partly blue color type is occasionally formed. Also, if the zinc ion concentration exceeds 2.0 g/l, although an uniform zinc phosphate coating film is formed, a coating film soluble in an alkali is easily formed, and there is a case where the coating film becomes easily-soluble under an alkali atmosphere to which it is exposed especially during cationic electrodeposition. As a result, the warm brine resistance generally diminishes and, especially in a case of an iron-based surface, scab resistance deteriorates and, thus, because desired capability is not obtained, the coating film is not suitable as a coating substrate for electrodeposition coating, especially, cationic electrodeposition coating.

If the phosphate ion concentration is less than 5 g/l, a ununiform coating film is easy to form and, if it exceeds 40 g/l, elevation of the effect is not expected and it is economically disadvantageous because an amount for use of chemicals becomes large.

If the concentration of the coating film-converting accelerator (a) is lower than the forementioned range, sufficient coating film-conversion does not occur on an iron-based surface and yellow rust is easy to form and also, if it exceeds the range, a ununiform coating film of a blue color type is easy to form on the iron-based surface.

In the treating solution used in the present invention, it is preferred to contain a manganese ion and a nickel ion in a defined concentration range in addition to the above-described components. A preferable range of the manganese ion is from 0.1 to 3 g/l and a more preferable one is from 0.6 to 3 g/l. If it is less than 0.1 g/l, the adhesion to a zinc-based surface and an elevating effect on the warm brine resistance becomes insufficient and, if it exceeds 3 g/l, an elevating effect on the corrosion resistance becomes insufficient. A preferable range of the nickel ion is from 0.1 to 4 g/l and a more preferable one is from 0.1 to 2 g/l. If it is less than 0.1 g/l, an elevating effect on the corrosion resistance becomes insufficient and, even if it exceeds 4 g/l, no more elevating effect on the corrosion resistance can be expected.

A treating solution used in this invention, if required, may include a coating film-converting accelerator (b) as well. Preferable coating film-converting accelerators (b) are, for example, a nitrate ion, a chlorate ion, etc. A preferable concentration of the nitrate ion is in a range of from 0.1 to 15 g/l and a more preferable one is in a range of from 2 to 10 g/l. A preferable concentration of the chlorate ion is in a range of from 0.05 to 2.0 g/l and a more preferable one is in a range of from 0.2 to 1.5 g/l. These components may be contained alone or in combination of two or more kinds. The coating film-converting accelerator (b) may be used in combination with the coating film-converting accelerator (a) or may not be used with (a).

In order to maximize the effect of this invention, it is preferred to maintain the acidity of a free acid (FA) in a treating solution in a range of from 0.1 to 0.8 and especially preferred to maintain it in a range of from 0.3 to 0.6. The FA is defined as an amount of consumed ml of a 0.1 N sodium hydroxide solution required to neutralize 10 ml of a treating solution using bromophenol blue as an indicator. If FA is 0.8 or less, treating properties of zinc phosphate for a metal surface, in particular, for an aluminum-based surface elevate and thus, coating properties elevate. However, if FA is less than 0.1, an equilibrium balance of the treating solution components lowers and the conversion properties lowers by precipitation of coating film-forming components.

A method for treating with zinc phosphate of this invention may be carried out by either one of the immersing treatment and spraying treatment, or may be carried out by both of the immersing treatment and spraying treatment. If it is carried out by the immersing treatment, there is an advantage that an uniform coating film can be made for an article of a complicate structure such as having a bag structure as well as for a part, where the spraying treatment can not make a coating film. Furthermore, if the spraying treatment is carried out after the immersing treatment being carried out, a zinc phosphate-based coating film is surely made and, in addition, removal of a formed insoluble precipitate can be surely carried out.

Also, in the method for treating with zinc phosphate of this invention, in a case of being carried out by the immersing method, it is preferred, before the zinc phosphate treatment, to carry out at least one of the spraying treatment and immersing treatment for a metal surface at room temperature for 10 to 30 seconds using a surface-conditioner.

A practically useful example of the treating method of this invention is shown as follows. A metal surface is degreased by at least one of the spraying treatment and immersing treatment at a temperature of from 20° to 60° C. for 2 minutes using an alkaline degreasing agent, and it is rinsed with tap water. Then, after the forementioned surface conditioning is carried out, the metal surface is treated by immersing it in the above-described treating solution at a temperature of from 20° to 70° C. for 15 seconds or more, and it is rinsed with tap water and then, with deionized water.

A concentration adjustment of a complex fluoride compound in a treating solution can be carried out by seeing the concentrations of silicon (Si), boron (B) and aluminum (Al), and by adding properly a concentrated supplementary solution containing a complex fluoride compound in such a manner that the treating solution is satisfactory for the above-described equation (I).

A preferable supplying source of the forementioned components in a treating solution used in this invention is, for example, as follows.

Zinc Ion

Zinc oxide, zinc carbonate, zinc nitrate and the like.

Phosphate Ion

Phosphoric acid, zinc phosphate, manganese phosphate and the like.

Coating Film-Converting Accelerator (a)

Nitrous acid, sodium nitrite, ammonium nitrite, sodium m-nitrobenzenesulfonate, hydrogen peroxide and the like.

Manganese Ion

Manganese carbonate, manganese nitrate, manganese chloride, manganese phosphate and the like.

Nickel Ion

Nickel carbonate, nickel nitrate, nickel chloride, nickel phosphate, nickel hydroxide and the like.

Nitrate Ion

Nitric acid, sodium nitrate, ammonium nitrate, zinc nitrate, manganese nitrate, nickel nitrate and the like.

Chlorate Ion

Sodium chlorate, ammonium chlorate and the like.

$SiF_6$

Hydrosilicofluoric acid, nickel hydrosilicofluoride, zinc hydrosilicofluoride, manganese hydrosilicofluoride, iron hydrosilicofluoride, magnesium hydrosilicofluoride, calcium hydrosilicofluoride and the like.

$BF_4$

Borofluoric acid, nickel borofluoride, zinc borofluoride, manganese borofluoride, iron borofluoride, magnesium borofluoride, calcium borofluoride and the like.

When a method for treating with zinc phosphate of this invention is carried out, a preferable temperature of the treating solution is in a range of from 20° to 70° C. and, a more preferable one is in a range of from 35° to 60° C. If it is lower than this range, the coating film-conversion is bad, so that it takes a long treating time. Also, if it is higher than the range, balancing of the treating solution is easily broken by decomposition of a coating film-converting accelerator and formation of a precipitate in the treating solution, so that an excellent coating film is hard to obtain.

A preferable treating time by the treating solution is 15 seconds or more and a more preferable one is in a range of from 30 to 180 seconds. If it is less than 15 seconds, there is a case where a coating film having desired crystals is not sufficiently formed. Furthermore, in a case where an article having a complicate structure such as an automobile body is treated, it is practically preferred to combine the immersing treatment with the spraying treatment, and in this case, an article is at first subjected to the immersing treatment for 15 seconds or more or, preferably, for a period of from 30 to 120 seconds and then, to the spraying treatment for 2 seconds or more or, preferably, for a period of from 5 to 45 seconds. Besides, to wash off sludge attaching in the course of immersing treatment, it is preferred to carry out the spraying treatment as long as possible. Accordingly, a method for treating with zinc phosphate of this invention includes the immersing treatment and spraying treatment as well as treating embodiment made by combining those treatment.

A treating solution used in this invention can be simply obtained by preparing a concentrated source solution containing each component in an amount more than a defined content beforehand and then, by diluting it with water so as to contain each component in a defined content.

The concentrated source solution has one-solution type and two-solution type, of which practical examples are shown by the following embodiments.

(1) One-solution type concentrated source solution in which a zinc ion-supplying source and a phosphate ion-supplying source are blended so as to make a 1 versus 2.5–400 ratio of the zinc ion to the phosphate ion in a weight ratio of the ionic forms.

(2) One-solution type concentrated source solution as the above-described (1), containing the forementioned coating film-converting accelerator (b) too, of which coexistence in an source solution condition does not cause any interference.

Furthermore, the one-solution type concentrated source solutions may contain a proper compound among the forementioned nickel ion-supplying source compound, manganese ion-supplying source compound, complex fluoride compound-supplying source compound, etc.

(3) Two-solution type concentrated source solution, which consists of an A solution containing at least a zinc ion-supplying source and phosphate ion-supplying source and a B solution containing at least the forementioned coating film-converting accelerator (a) and, which is used so that a zinc ion-supplying source and a phosphate ion-supplying source shows a 1 versus 2.5–400 ratio of the zinc ion to the phosphate ion in a weight ratio of the ionic forms.

A preferable compound being contained in the B solution is such as the forementioned coating film-converting accelerator (a) which shows interference in coexistence with a zinc ion-supplying source and a phosphate ion-supplying source.

The concentrated source solutions usually contain each component so as to use those by diluting 10 to 100 times by weight in the case of one-solution type, 10 to 100 times by weight in the case of A solution, and 100 to 1,000 times by weight in the case of B solution.

In a case of the two-solution type consisting of the above-mentioned A and B solutions, there can be separately arranged the compounds which, if they coexist under a condition of source solutions, are inconvenient.

For example, in a case of the two-solution type, a zinc ion-supplying source, phosphate ion-supplying source, nitrate ion-supplying source, nickel ion-supplying source and manganese ion-supplying source are contained in the A solution. A complex fluoride compound-supplying source may be contained in the A or B solution, or added separately. A chlorate ion-supplying source may be contained in either the A or B solution. A nitrite ion-supplying source, m-nitrobenzenesulfonic acid ion-supplying source and hydrogen peroxide-supplying source are contained in the B solution.

Besides, in a case where the A solution contains a manganese ion-supplying source, it is preferred that the chlorate ion-supplying source is contained in the B solution.

In the course of treating with zinc phosphate, because a component in the treating solution is consumed partially, this consumed component should be supplemented. A concentrated solution for this supplement is prepared, for example, by combining the one-solution type concentrated source solution, the A solution or B solution in a ratio which varies according to the consumed proportion of each component.

When a metal surface, especially, a metal surface containing an aluminum-based surface is treated with zinc phosphate, aluminum ions dissolved into a treating solution causes inferior chemical conversion as the concentration of the aluminum ions increases. Because of this, in this invention, even if the aluminum ion concentration increases, an excellent coating film can be made on an iron-based surface, a zinc-based surface and an aluminum-based surface, by controlling the concentration of a complex fluoride compound in the treating solution so as to be satisfactory for the forementioned equation (I). Also, since aluminum does not precipitate in the treating solution, uniformity of the coating film is not damaged.

According to the treating method of this invention, an iron-based, a zinc-based, and an aluminum-based surface as well as a metal surface having two kinds or more of these surfaces can be treated with the same zinc phosphate treating solution and, even if treating times increases, a coating film having superior adhesion and high corrosion resistance can be made under a stable condition, and there can be prevented a precipitate being formed in the treating solution by a metal ion, especially, by an aluminum ion eluted from a metal surface that is an article to be treated.

DESCRIPTION OF THE PREFERRED EMBODIMENTS

Hereinafter, practical examples and comparative examples of the present invention are shown, but the present invention is not limited to the undermentioned examples.

Examples 1 to 11 and Comparative Examples 1 to 8

Metal to be Treated

Iron-based surface: cold rolled steel sheet [SPCC in Japanese Industrial Standard (JIS); hereinafter, referred to as "SPCC"].

Zinc-based surface: alloyed melt zinc-plated steel sheet (hereinafter, referred to as "GA").

Iron-based and zinc-based surface: iron-zinc alloy electroplated steel sheet (hereinafter, referred to as "SEMC").

Aluminum-based surface; aluminum sheet (an aluminum material having an alloy number 5182 in JIS H4000; hereinafter, referred to as "Al").

Treating Solution

An aqueous acid phosphate treating solution having compositions shown in Tables 1 to 3.

Treating process (a) degreasing, (b) rinsing, (c) surface-conditioning, (d) conversion, (e) rinsing, (f) rinsing with pure water, (g) drying and (h) coating are carried out in this sequence.

(a) Degreasing

It is carried out by the immersing treatment or spraying treatment.

Using a 2% by weight aqueous solution of an alkaline degreasing agent (Surf Cleaner SD 550, made by Nippon Paint Co., Ltd.), a metal to be treated was immersed at 45° C. for 2 minutes (examples 1 to 7 and 11, and comparative examples 1 to 5 and 8).

Using a 2% by weight aqueous solution of an alkaline degreasing agent (Surf Cleaner S 102, made by Nippon Paint Co., Ltd.), a metal to be treated was sprayed at 50° C. for 2 minutes (examples 8 to 10, and comparative examples 6 and 7).

(b) Rinsing

A metal to be treated was sprayed by tap water at room temperature for 15 seconds.

(c) Surface-conditioning

Using a 0.1% by weight aqueous solution of a surface conditioner (Surf Fine 5N-8 for making, made by Nippon Paint Co., Ltd.), a metal to be treated was immersed at room temperature for 30 seconds. The surface-conditioning is carried out for metals, which undergo conversion by the immersing treatment (examples 1 to 7 and 11, and comparative examples 1 to 5 and 8), but it is not carried out for metals, which undergo conversion by spraying (examples 8 to 10 and comparative examples 6 and 7).

(d) Conversion

In the examples 1 to 7 and 11 and comparative examples 1 to 5 and 8, using a treating solution having composition shown in Tables 1 to 3, all metals to be treated were immersed in the same treating solution at 45° C. for 2 minutes.

In the examples 8 to 10 and comparative examples 6 and 7, using a treating solution having composition shown in Tables 1 to 3, all metals to be treated were sprayed by the same treating solution at 50° C. for 2 minutes. In the case of spraying, a treating solution vomited from a spraying nozzle is collected into a tank and then, circulated so as to be vomited again from the spraying nozzle.

Besides, in a treating solution used for the conversion (treating with zinc phosphate), the concentrations of a zinc ion, a nickel ion, a manganese ion, a phosphate ion (upon converting into a $PO_4^{3-}$ ion), a nitrate ion, a nitrite ion and a chlorate ion as well as the values of FA are managed so as to show the numeral values shown in Tables 1 to 3, and the concentrations of $SiF_6$ and $BF_4$ are managed so as to be satisfactory for the above-described equations (I) or (II) (however, in the example 1, when composition shown in Table 1 was achieved, the complex fluoride compound was not yet supplemented). Although the aluminum ion concentration in the treating solution was initially zero, it increased as the treating progressed (as a sheet number of a metal to be treated increased). Then, when the aluminum ion concentration reaches the values shown in Tables 1 to 3, treated sheets were submitted to the undermentioned tests and, bath composition at this time is the composition of a treating solution shown in Tables 1 to 3.

(e) Rinsing

Metals to be treated were sprayed by tap water at room temperature for 15 seconds.

(f) Rinsing with Pure Water

Metals to be treated were sprayed by ion-exchange water at room temperature for 15 seconds.

(g) Drying

Metals to be treated were dried at 100° C. for 10 minutes.

(h) Coating

A cationic electrodeposition coating (Power Top U-30 dark grey, made by Nippon Paint Co., Ltd.) was coated by cationic electrodeposition coating on metals to be treated, which then baked at 170° C. for 25 minutes. Thickness of the baked and dried film was 20 μm. On the electrodeposition coated film, an intermediate coat (Orga P-2 grey, made by Nippon Paint Co., Ltd.) was coated by spray coating and baked at 140° C. for 25 minutes. A formed intermediate coated film had a baked and dried film thickness of 35 μm. On the intermediate coated film, a finish coating (Orga S-30 white, made by Nippon Paint Co., Ltd.) was coated by spray coating and baked at 140° C. for 25 minutes. A formed finish coated film had a baked and dried film thickness of 40 μm.

Concerning the obtained coated sheets, exterior appearance of coating films, coating film weight, adhesion and corrosion resistance were investigated and results are shown in Tables 4 to 6.

The exterior appearance of coating films was investigated, after the conversion, by examining exterior appearance of the zinc phosphate coating films by the naked eye.

The coating film weight was calculated by dissolving a zinc phosphate coating film after the conversion and by measuring weight of the film after and before the dissolving. For Al, the coating film was dissolved by immersing it in nitric acid (1:1) at room temperature for 1 minute. For other sheets, the coating films were dissolved by immersing them in an aqueous 5% by weight chromic acid solution at 75° C. for 15 minutes.

The adhesion was evaluated by that three coated sheets were immersed in ion-exchange water at 50° C. for 10 days, cuts of checkerboard squares (100 pieces at 2 mm intervals) were made on a coated film by a keen cutter, an adhesive tape was pasted up on these sheets and then, peeled off, and it was counted how many cut square pieces were peeled off from the coated sheets among the above cut 100 pieces.

The corrosion resistance was investigated by a brine-spraying test, filiform corrosion test and cyclic corrosion test according to JIS-Z2371. The brine-spraying test was carried out by that a cationic electrodeposition coated film was formed, cross cuts were made on the film, and a 5% by weight aqueous sodium chloride solution was continuously sprayed for 500 hours (for only GA) or for 1,000 hours (for SPCC, SEMC and Al), and a maximum corroded width from the cut parts (one side of the cut parts) was measured. The filiform corrosion test was carried out by that cross cuts (cut length 20 cm) were made on the coating films of three coated sheets by using a keen cutter, the brine-spraying test for 24 hours (JIS-Z2371) and a wetting test (temperature 50° C. and relative humidity 85%) for 500 hours were carried out in this order, and a maximum corroded width from the cut parts (one side of the cut parts) was measured. The cyclic corrosion test was carried out by that cross cuts were made on the coating films of three coated sheets by using a keen cutter, tests of one cycle which consists of the brine spraying test (JIS-Z2371, for 24 hours), wetting test (for 120 hours under an atmosphere of temperature 40° C. and relative humidity 85%) and a standing test in the interior of a room (for 24 hours) and in which the tests are carried out in this order, was repeated four times, and a maximum corroded width from the cut parts (one side of the cut parts) was measured.

TABLE 1

| | | | example 1 | example 2 | example 3 | example 4 | example 5 | example 6 | example 7 |
|---|---|---|---|---|---|---|---|---|---|
| treatment with zinc phosphate | | treating method | | | | immersing | | | |
| | formulation of treating solution [g/l] | $Zn^{2+}$, $Ni^{2+}$, $Mn^{2+}$, $PO_4^{3-}$, $NO_3^-$ | | | | $Zn^{2+}$ = 1.0, $Ni^{2+}$ = 1.0, $Mn^{2+}$ = 0.6, $PO_4^{3-}$ = 150, $NO_3^-$ = 6.0 | | | |
| | | $NO_2^-$, $ClO_3^-$ | | | | $NO_2^-$ = 0.07, $ClO_3^-$ = 0 | | | |
| | | $Al^{3+}$ | 0.01 | 0.1 | | | 0.3 | | |
| | | $SiF_6^{2-}$ | 1.0 | 1.8 | 0 | 5.0 | 3.0 | 3.0 | 3.5 |
| | | $BF_4^-$ | 0 | | 5.5 | | 0 | 2.0 | 0 |
| | | $[SiF_6^{2-}] + \frac{1}{5}[BF_4^-] - 8[Al^{3+}]$ | 1.0 | 1.0 | 0.3 | 2.6 | 0.6 | 1.0 | 1.1 |
| | | FA [point] | | | | 0.6 | | | 0.9 |
| | | TA [point] | 21.0 | 24.0 | 21.0 | 35.0 | 28.0 | 30.0 | 30.0 |

TABLE 2

| | | | example 8 | example 9 | example 10 | example 11 | comparative example 1 | comparative example 2 | comparative example 3 |
|---|---|---|---|---|---|---|---|---|---|
| treatment with zinc phosphate | | treating method | | spraying | | | immersing | | |
| | formulation of treating solution [g/l] | $Zn^{2+}$, $Ni^{2+}$, $Mn^{2+}$, $PO_4^{3-}$, $NO_3^-$ | | | | $Zn^{2+}$ = 1.0, $Ni^{2+}$ = 1.0, $Mn^{2+}$ = 0.6, $PO_4^{3-}$ = 150, $NO_3^-$ = 6.0 | | | |
| | | $NO_2^-$, $ClO_3^-$ | $NO_2^-$ = 0.05, $ClO_3^-$ = 0.3 | | | 0 | $NO_2^-$ = 0.07, $ClO_3^-$ = 0 | | |
| | | $Al^{3+}$ | | 0.3 | | 0.5 | 0.01 | | 0.1 |
| | | $SiF_6^{2-}$ | 5.0 | 2.5 | 3.0 | 5.0 | 3.5 | 0.8 | 0 |
| | | $BF_4^-$ | 0 | | 2.0 | | 0 | | 4.0 |
| | | $[SiF_6^{2-}] + \frac{1}{5}[BF_4^-] - 8[Al^{3+}]$ | 2.6 | 0.1 | 1.0 | 1.0 | 3.5 | 0 | 0 |
| | | FA [point] | | | | 0.6 | | | |
| | | TA [point] | 35.0 | 26.0 | 30.0 | 35.0 | 30.0 | 21.0 | 21.0 |

TABLE 3

| | | | comparative example 4 | comparative example 5 | comparative example 6 | comparative example 7 | comparative example 8 |
|---|---|---|---|---|---|---|---|
| treatment with | | treating method | immersing | | spraying | | immersing |
| | formulation | $Zn^{2+}$, $Ni^{2+}$, | $Zn^{2+}$ = 1.0, $Ni^{2+}$ = 1.0, $Mn^{2+}$ = 0.6, | | | | |

TABLE 3-continued

| | | | comparative example 4 | comparative example 5 | comparative example 6 | comparative example 7 | comparative example 8 |
|---|---|---|---|---|---|---|---|
| zinc phosphate | of treating solution [g/l] | $Mn^{2+}$, $PO_4^{3-}$, $NO_3^-$ | $PO_4^{3-}$ = 150, $NO_3^-$ = 6.0 | | | | |
| | | $NO_2^-$, $ClO_3^-$ | $NO_2^-$ = 0.07, $ClO_3^-$ = 0 | | $NO_2^-$ = 0.05, $ClO_3^-$ = 0.3 | | $NO_2^-$ = 0.07, $ClO_3^-$ = 0 |
| | | $Al^{3+}$ | 0.1 | | | | 0.3 |
| | | $SiF_6^{2-}$ | 4.0 | 0 | 0.8 | 4.0 | 2.0 |
| | | $BF_4^-$ | 0 | 20.0 | 0 | | 1.5 |
| | | $[SiF_6^{2-}] + \frac{1}{5}[BF_4^-] - 8[Al^{3+}]$ | 3.2 | 3.2 | 0 | 3.2 | −0.1 |
| | | FA [point] | 0.6 | | | | |
| | | TA [point] | 30.0 | 30.0 | 21.0 | 30.0 | 25.0 |

TABLE 4

| | | example 1 | example 2 | example 3 | example 4 | example 5 | example 6 | example 7 |
|---|---|---|---|---|---|---|---|---|
| exterior appearance of coating film | SPCC | uniform, fine, and excellent | | | | | | |
| | GA | uniform, fine, and excellent | | | | | | |
| | SEMC | uniform, fine, and excellent | | | | | | |
| | Al | uniform, fine, and excellent | | | | | | |
| coating film weight [g/m²] | SPCC | 2.0 | 2.0 | 2.3 | 1.9 | 2.1 | 2.0 | 2.0 |
| | GA | 2.6 | 2.6 | 2.8 | 2.3 | 2.7 | 2.6 | 2.6 |
| | SEMC | 2.0 | 2.0 | 2.3 | 1.9 | 2.1 | 2.0 | 2.0 |
| | Al | 1.8 | 1.8 | 1.5 | 1.9 | 1.7 | 1.8 | 1.5 |
| adhesion [piece] | SPCC | 0 | | | | | | |
| | GA | 0 | | | | | | |
| | SEMC | 0 | | | | | | |
| | Al | 0 | | | | | | |
| filiform corrosion test [mm] | Al | 1.0 | | | | | | |
| brine-spraying test [mm] | SPCC | 1.0 | | | | | | |
| | GA | 1.5 | | | | | | |
| | SEMC | 1.0 | | | | | | |
| | Al | 0.5 | | | | | | |
| cyclic corrosion test [mm] | SPCC | 2.0 | | 2.5 | | 2.0 | | |
| | Al | 1.0 | | 1.5 | | 1.0 | | 1.5 |

TABLE 5

| | | example 8 | example 9 | example 10 | example 11 | comparative example 1 | comparative example 2 | comparative example 3 |
|---|---|---|---|---|---|---|---|---|
| exterior apperance of coating film | SPCC | uniform, fine, and excellent | | | | uniform, fine | ununiform, rough | |
| | GA | uniform, fine, and excellent | | | | uniform, fine | ununiform, rough | |
| | SEMC | unfirom, fine, and excellent | | | | uniform, fine | ununiform, rough | |
| | Al | uniform, fine, and excellent | | | | uniform, fine | no coating film | |
| coating film weight [g/m²] | SPCC | 1.6 | 1.9 | 1.8 | 2.0 | 1.5 | 2.5 | 2.5 |
| | GA | 2.2 | 2.5 | 2.4 | 2.6 | 2.5 | 2.9 | 2.9 |
| | SEMC | 1.6 | 1.9 | 1.8 | 2.0 | 1.5 | 2.5 | 2.5 |
| | Al | 2.0 | 1.6 | 1.8 | 1.8 | 1.9 | 0 | 0 |
| adhesion [piece] | SPCC | 0 | | | | | | |
| | GA | 0 | | | | 1 | | |
| | SEMC | 0 | | | | | | |
| | Al | 0 | | | | | | |
| filiform corrosion test [mm] | Al | 1.0 | | | | 1.5 | | |
| brine-spraying test [mm] | SPCC | 1.5 | | | 1.0 | 2.0 | | |
| | GA | 2.0 | | | 1.5 | 2.0 | 2.5 | |
| | SEMC | 1.5 | | | 1.0 | 1.5 | 2.0 | |
| | Al | 0.5 | | | | 1.5 | | |
| cyclic corrosion test [mm] | SPCC | 2.5 | | | 2.0 | 3.0 | 3.5 | |
| | Al | 1.0 | | | | | | 2.0 |

TABLE 6

| | | comparative example 4 | comparative example 5 | comparative example 6 | comparative example 7 | comparative example 8 |
|---|---|---|---|---|---|---|
| exterior appearance of coating film | SPCC | uniform, fine | | ununiform, rough | uniform, fine | ununiform, rough |
| | GA | uniform, fine | | ununiform, rough | uniform, fine | ununiform, rough |
| | SEMC | uniform, fine | | ununiform, rough | uniform fine | ununiform, rough |
| | Al | uniform, fine | | no coating film | uniform, fine | no coating film |
| coating film weight [g/m²] | SPCC | 1.5 | 1.5 | 2.5 | 1.5 | 2.5 |
| | GA | 2.5 | 2.5 | 2.9 | 2.5 | 3.2 |
| | SEMC | 1.5 | 1.5 | 2.5 | 1.5 | 2.5 |
| | Al | 1.9 | 1.9 | 0 | 2.1 | 0 |
| adhesion [piece] | SPCC | | | 0 | | |
| | GA | 0 | | 1 | 0 | 20 |
| | SEMC | | | 0 | | |
| | Al | | | 0 | | |
| filiform corrosion test [mm] | Al | 1.0 | | 1.5 | 1.0 | 1.5 |
| brine-spraying test [mm] | SPCC | 2.0 | | 2.5 | | 2.0 |
| | GA | 2.0 | | 3.5 | 3.0 | 2.5 |
| | SEMC | 1.5 | | 2.5 | 2.0 | 2.0 |
| | Al | 0.5 | | 1.5 | 0.5 | 1.5 |
| cyclic corrosion test [mm] | SPCC | 3.0 | | 4.0 | 3.5 | 3.5 |
| | Al | 1.0 | | 2.0 | 1.0 | 2.5 |

As seen in Tables 4 to 6, according to the zinc phosphate treatment in the examples, a zinc phosphate coating film having an uniform, fine and excellent exterior appearance is made, and the adhesion and corrosion resistance of the coating film are also excellent.

What is claimed are:

1. A method for treating a metal surface comprising at least an aluminum containing metal surface with zinc phosphate, which comprises making a zinc phosphate coating film on a metal surface comprising at least an aluminum containing metal surface by bringing the metal surface comprising at least an aluminum containing metal surface in contact with a zinc phosphate treating solution, said treating solution comprising:

0.1 to 2.0 g/l of zinc ions, 5 to 40 g/l of phosphate ions, 0.1 to 3 g/l of manganese ions, 0.1 to 4 g/l of nickel ions, and at least one coating film-converting accelerator selected from the group consisting of:

i) 0.01 to 0.5 g/l of nitrite ions, ii) 0.05 to 5 g/l of m-nitrobenzenesulfonic acid ions, and iii) 0.5 to 10 g/l of hydrogen peroxide;

said method further comprising adding a complex fluoride compound to the treating solution so that a concentration, in g/l, of the complex fluoride compound contained in said treating solution when converted into at least one of a hexafluorosilicic acid group and a tetrafluoroboric acid group, with an aluminum ion concentration, in g/l, contained in said treating solution, satisfies the following equation (I), $$3.0 \geqq [SiF_6^{2-}] + \frac{1}{5}[BF_4^-] - 8[Al^{3+}] \geqq 0.1 \quad (I)$$

wherein the aluminum ion is substantially prevented from precipitating.

2. The method according to claim 1, wherein an acidity of a free acid in the treating solution is adjusted in a range of from 0.1 to 0.8.

3. The method according to claim 1, wherein, when the metal surface comprising at least an aluminum containing metal surface is treated with zinc phosphate by immersing it in a treating solution, the complex fluoride compound is added so that a concentration, in g/l, of the complex fluoride compound contained in said treating solution when converted into at least one of a hexafluorosilicic acid group and a tetrafluoroboric acid group, with an aluminum ion concentration, in g/l, contained in said treating solution, satisfies the following equation (II), $$3.0 \geqq [SiF_6^{2-}] + \frac{1}{5}[BF_4^-] - 8[Al^{3+}] \geqq 0.5 \quad (II)$$

* * * * *